US006253643B1

(12) United States Patent
Buck

(10) Patent No.: US 6,253,643 B1
(45) Date of Patent: Jul. 3, 2001

(54) JAW ASSEMBLY

(76) Inventor: David A. Buck, 1348 Sawmill Hwy., Breaux Bridge, LA (US) 70517

( * ) Notice: Subject to any disclaimer, the term of this patent is extended or adjusted under 35 U.S.C. 154(b) by 0 days.

(21) Appl. No.: 09/304,195

(22) Filed: May 3, 1999

Related U.S. Application Data

(63) Continuation-in-part of application No. 08/805,422, filed on Feb. 25, 1997, now Pat. No. 5,911,796.

(51) Int. Cl.[7] ..... B25B 13/50; B25B 13/58
(52) U.S. Cl. ..... 81/57.33; 81/185.1
(58) Field of Search ..... 81/57.15, 57.16, 81/57.18, 57.19, 57.2, 57.21, 57.33, 57.34, 185.1, 421–424, 186, 269, 263, 268, 271–272, 275, 279–284

(56) References Cited

U.S. PATENT DOCUMENTS 2,656,751 * 10/1953 Johnson et al. ..... 81/186
3,365,762 * 1/1968 Spiri ..... 81/186
4,576,067 * 3/1986 Buck ..... 81/185.1

* cited by examiner

*Primary Examiner*—D. S. Meislin
(74) *Attorney, Agent, or Firm*—Roy, Kiesel & Tucker

(57) ABSTRACT

The present invention provides a jaw assembly and die insert for use in conventional power tongs, back-up power tongs, and similar tools. The die insert has a rear surface having a plurality of splines extending outwardly from the rear surface and forming a plurality of grooves between the splines. The die also has a front surface adapted to grip a tubular member and a keyway formed on the rear surface. A mating jaw member is provided which also has a front face of splines and grooves with a keyway which aligns with the die's keyway when the die is inserted into the jaw. A key is inserted into this combined keyway to prevent vertical forces from drawing the die out of the jaw member.

4 Claims, 8 Drawing Sheets

JAW ASSEMBLY

This is a continuation-in-part of Ser. No. 08/805,422 filed Feb. 25, 1997 now U.S. Pat. No. 5,911,796.

BACKGROUND OF INVENTION

The present invention relates to tools used in the in the oil and gas drilling industry to grip and rotate tubular members such as drill pipe. More particularly, the present invention relates to the jaw assembly, which is the component of such tools actually coming into contact with the tubular.

In the oil and gas drilling industry, a certain class of machines known as power tongs are employed to grip and rotate drill pipe and other tubular members in the process of making up or breaking apart the joints on a string of tubulars. Typically, when a tubular joint is be made up or broken apart, back-up power tongs will grip the tubular on one side of the joint and power tongs will grip the tubular on the opposite side of the joint. The power tongs are used to apply torque to one tubular while the back-up power tongs (hereinafter referred to simply as back-up tongs) are used to hold the other tubular stationary against rotation. Both the back-up tongs and the power tongs must have a means to securely grip the tubular when large torque loads are being applied. One such gripping means is a jaw member having a concave shaped die insert such as seen in U.S. Pat. No. 4,576,067 to Buck. The die insert may have a knurled surface in order to better grip the tubular. However, the die must be easily replaceable in the jaw member because the knurled surface is eventually worn smooth during use and loses its gripping characteristics. While being replaceable, the dies must also be able to transfer large torque loads between the jaw member and the tubular without the die breaking its mounting in the jaw member. One successful solution to this problem is disclosed in U.S. Pat. No. 4,576,067 to Buck where the jaw member and die have a plurality splines and grooves that interlock lock the jaw member and die together.

However, the torque load imparting a force transverse to the splines and grooves is not the only force acting on the die. In certain situations, a vertical force parallel to the spline and grooves is exerted on the dies. To resist this vertical force, the prior art typically employed some type of retaining screw. If the vertical force becomes great enough, the retaining screw fails and the die is displaced from the jaw. What is needed in the art is an improved method of making the die secure in the jaw member from vertical displacement.

SUMMARY OF INVENTION

The present invention provides a jaw assembly and die insert for use in conventional power tongs, back-up power tongs, and similar tools. The die insert has a rear surface having a plurality of splines extending outwardly from the rear surface and forming a plurality of grooves between the splines. The die also has a front surface adapted to grip a tubular member and a keyway formed on the rear surface. A mating jaw member is provided which also has a front face of splines and grooves with a keyway which aligns with the die's keyway when the die is inserted into the jaw member. A key is inserted into this combined keyway to prevent vertical forces from drawing the die out of the jaw member.

DETAILED DESCRIPTION

Figure 1:
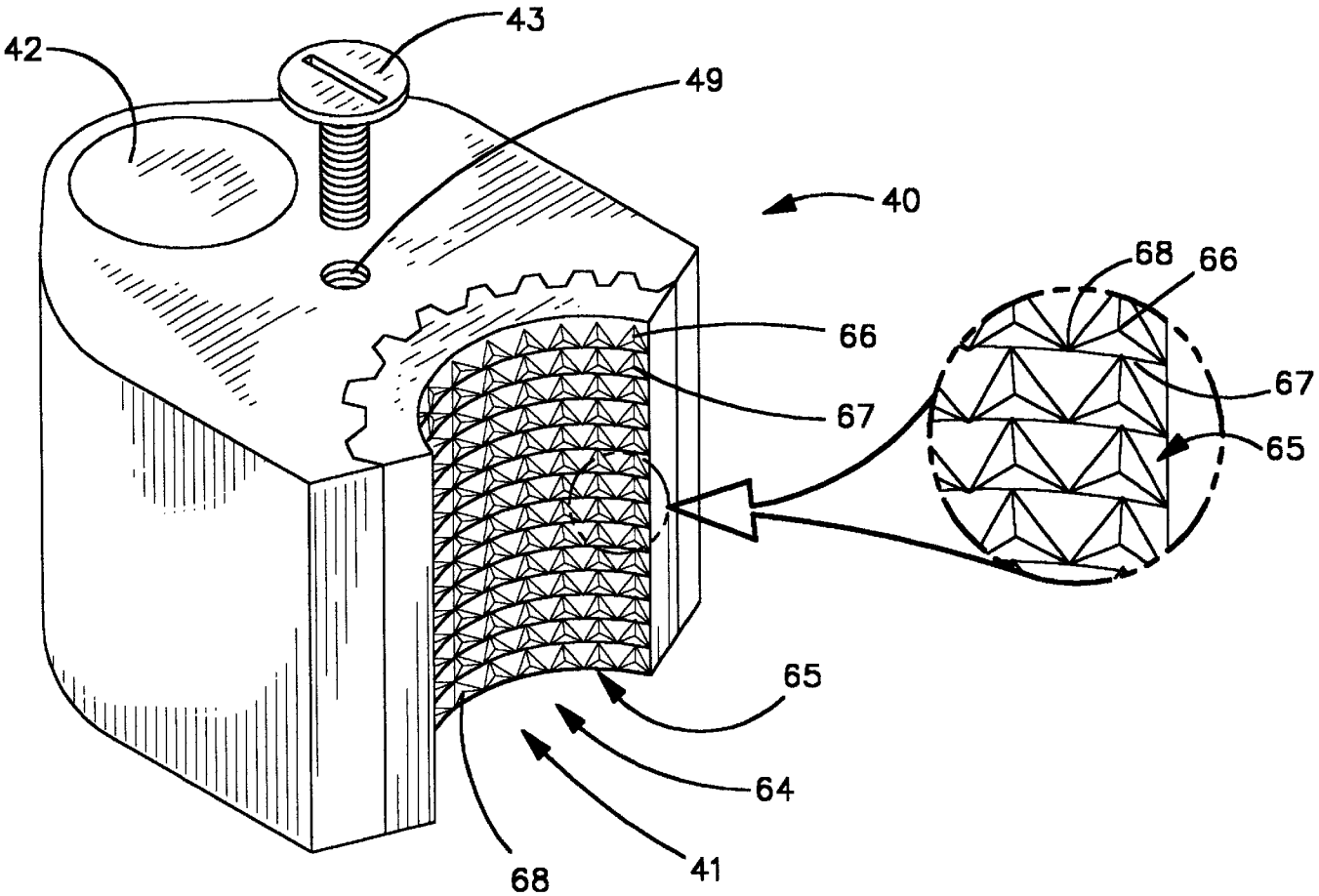
PRIOR ART FIGURE 1
FIG. 1 is a perspective view of a prior art jaw assembly.
Figure 2:
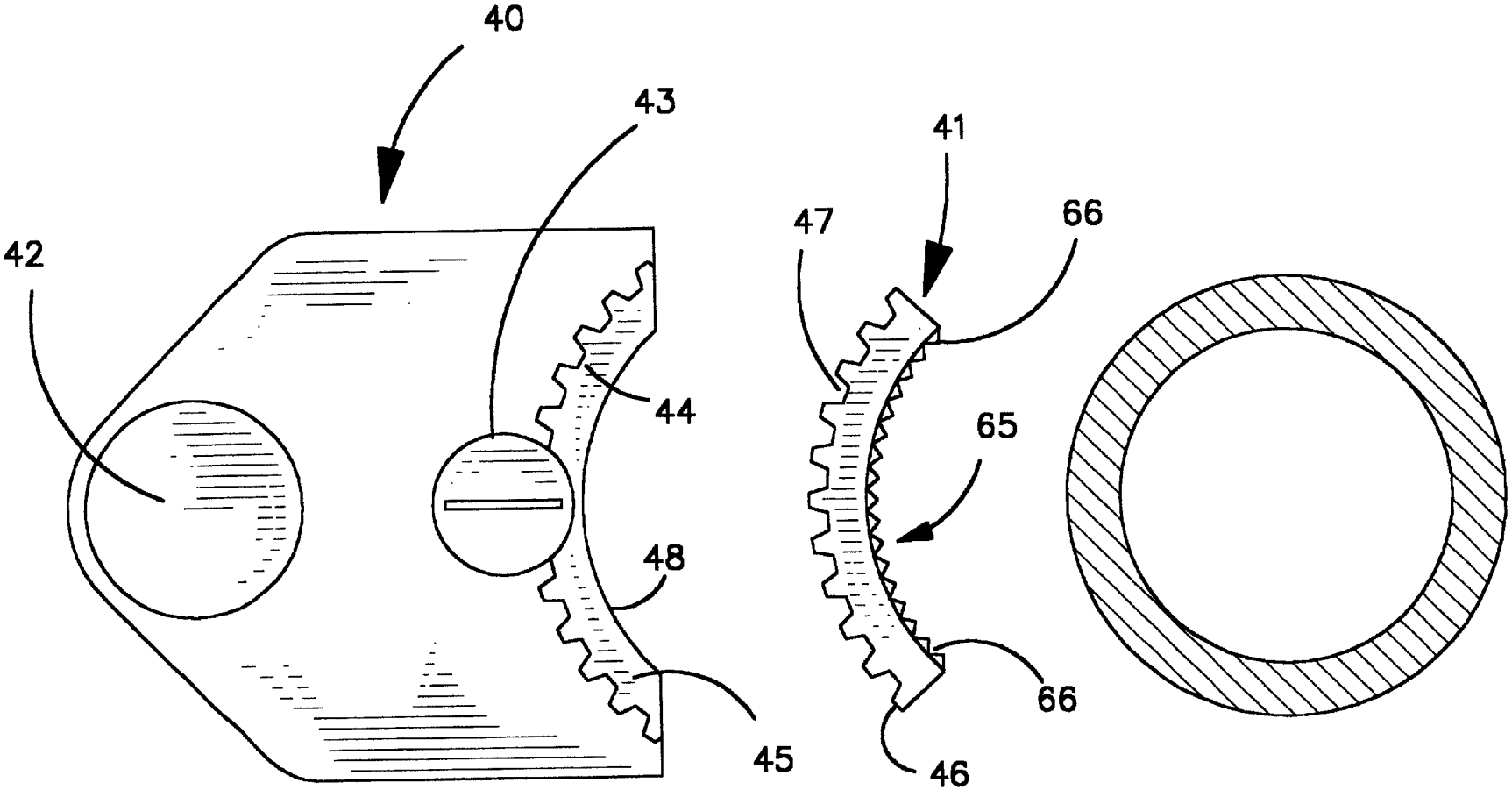
PRIOR ART FIGURE 2
FIG. 2 is a top view of the same prior art jaw assembly.

The prior art jaw assembly and die insert are depicted in FIGS. 1 and 2 and are explained thoroughly in U.S. Pat. No. 4,576,067 to Buck which is incorporated by reference herein. The jaw member 40 has a pin aperture 42 for pinning jaw member 40 into the power tongs 30 (seen in FIG. 3) or back-up tongs 34 (seen in FIG. 4). The jaw member 40 further has a concave surface with a plurality of splines 44 and grooves 45 which matingly engage corresponding splines 46 and grooves 47 in die 41. Die 41 may slide into position in jaw member 40 and is retained in the downward direction by lip 48 which is formed at the bottom of the concave surface of jaw member 40. To secure die 41 from sliding upward and out of jaw member 40, retaining screw 43 is threaded into aperture 49 and the head of retaining screw 43 overlaps die 41 in order to prevent upward movement of die 41.

Die 41 typically has a gripping surface 64, which is shown in FIG. 1 as being formed from a pattern of raised metal teeth 65. Each of the teeth 65 will include peak 66 which will be the first part of the teeth 65 to contact and bite into the tubular member being gripped. Between the peaks 66 of teeth 65 are depressions or valleys. The gripping surface 64 seen in FIG. 1 includes horizontal depressions 67 and vertical depressions 68. However, the depressions need not be horizontal and vertical or run perpendicular to one another. It is only necessary that the depressions substantially surround teeth 65 in order to form peaks 66. This allows the peaks 66 to bite into a tubular and for teeth 65 to resist slipping between die 41 and the tubular in the horizontal direction, the vertical direction, or any other direction.

Teeth 65 with peaks 66 should be distinguished from other prior art gripping surfaces such as that disclosed in U.S. Pat. No. 2,656,751 to Johnson, which is incorporated by reference herein. Johnson discloses a pipe wrench having jaws with ridges running parallel to the long axis of the pipe being gripped. The ridges will resist slippage between the wrench and pipe when torque is applied. However, if an axial force is applied to the wrench, the ridges will be prone to slipping along the surface of the pipe. This slipping will occur because the ridges are continuous along the axial direction in which the force is applied. Therefore, the ridges cannot bite into the pipe in a manner to prevent slippage in the axial direction.

Nor should only the gripping surface 64 as shown in FIG. 1 be considered teeth with peaks and depressions. Co-pending application Ser. No. 09/267,174 to Daniel Bangert, filed on Mar. 12, 1999, discloses a gripping surface formed of granular particles. The granular particles are also intended to be considered as teeth having peaks and depressions between adjacent particles.

Figure 3:
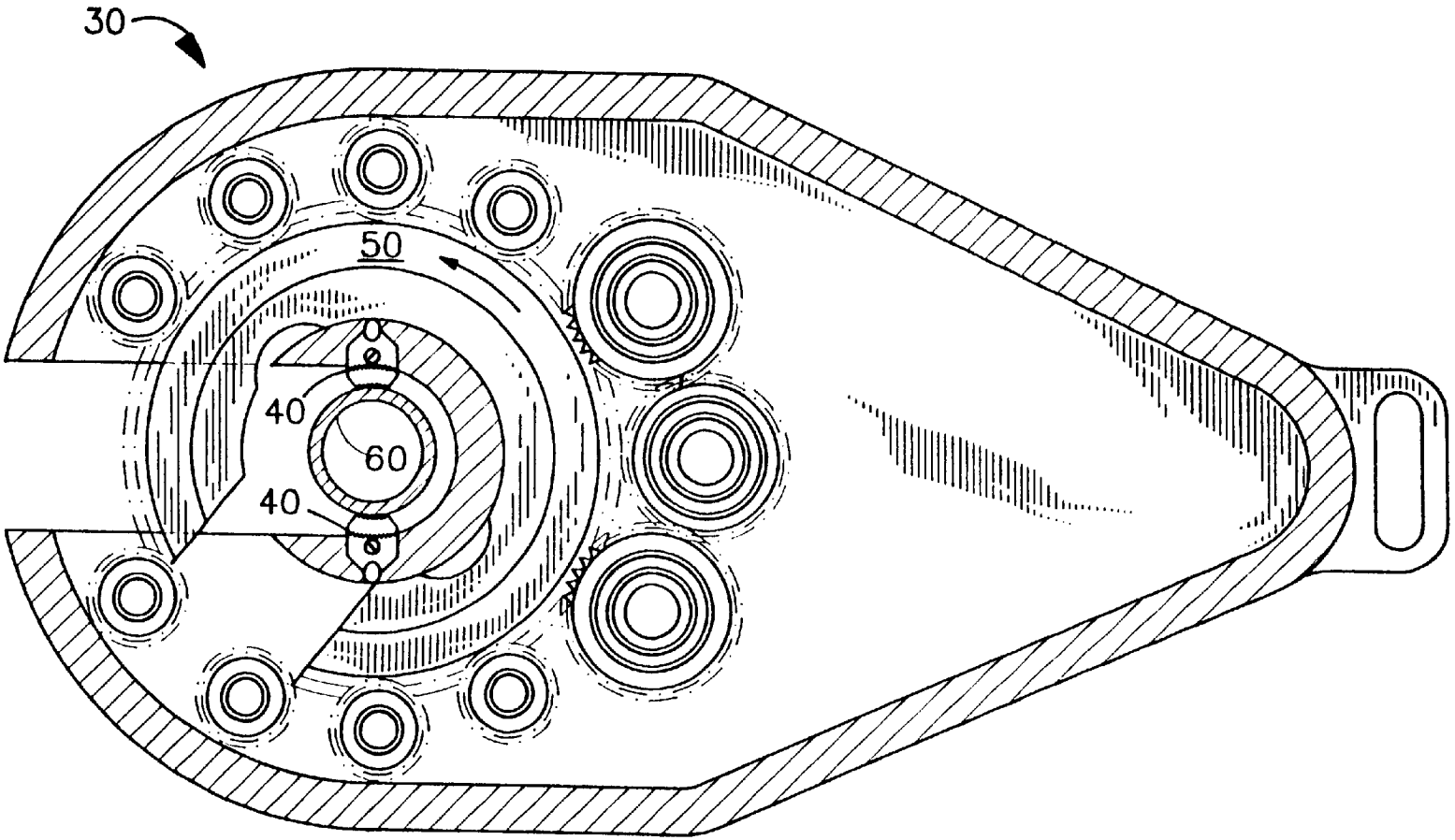
PRIOR ART FIGURE 3
FIG. 3 is a top view of the interior of a prior art power tong illustrating the placement of the jaw assemblies.
Figure 4:
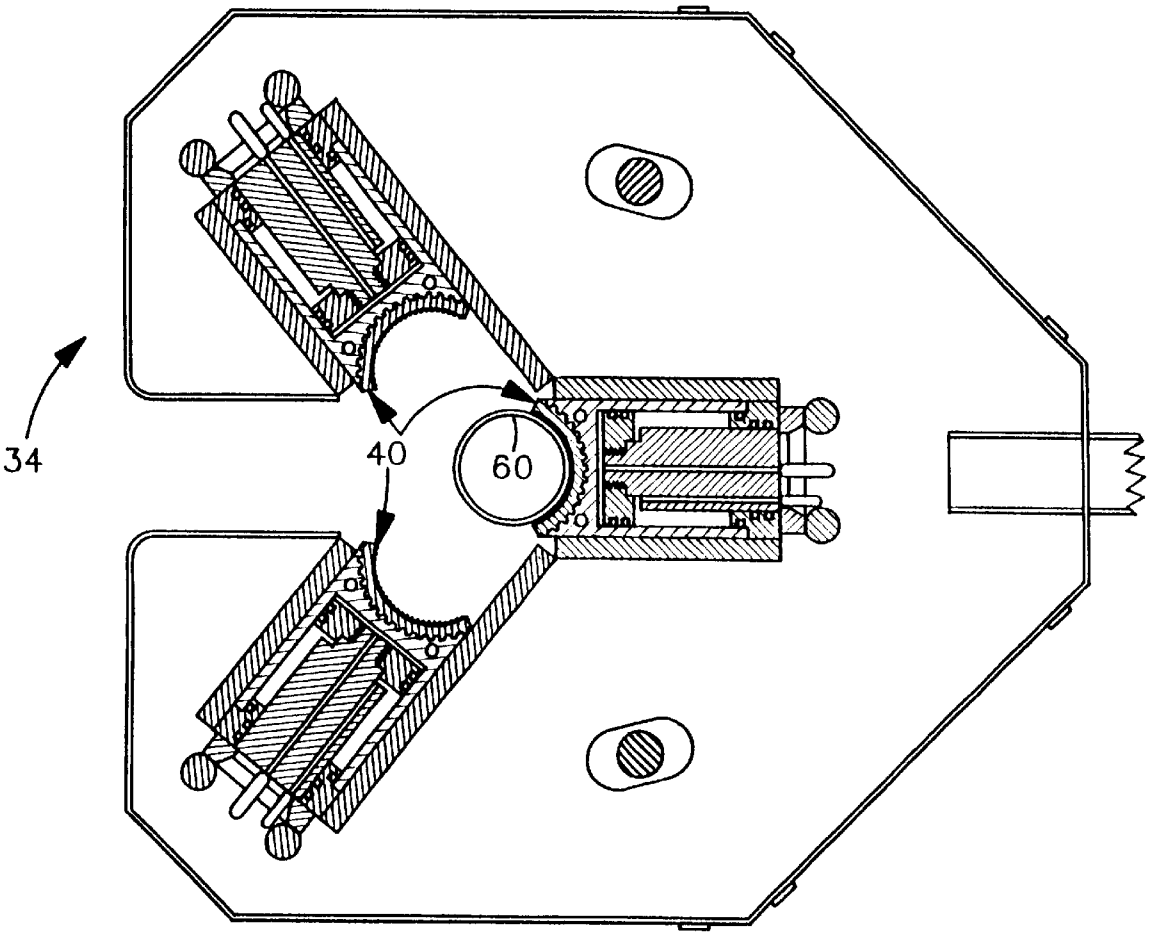
PRIOR ART FIGURE 4
FIG. 4 is a top view of the interior of a prior art back-up power tong illustrating the placement of the jaw assemblies.
Figure 5:
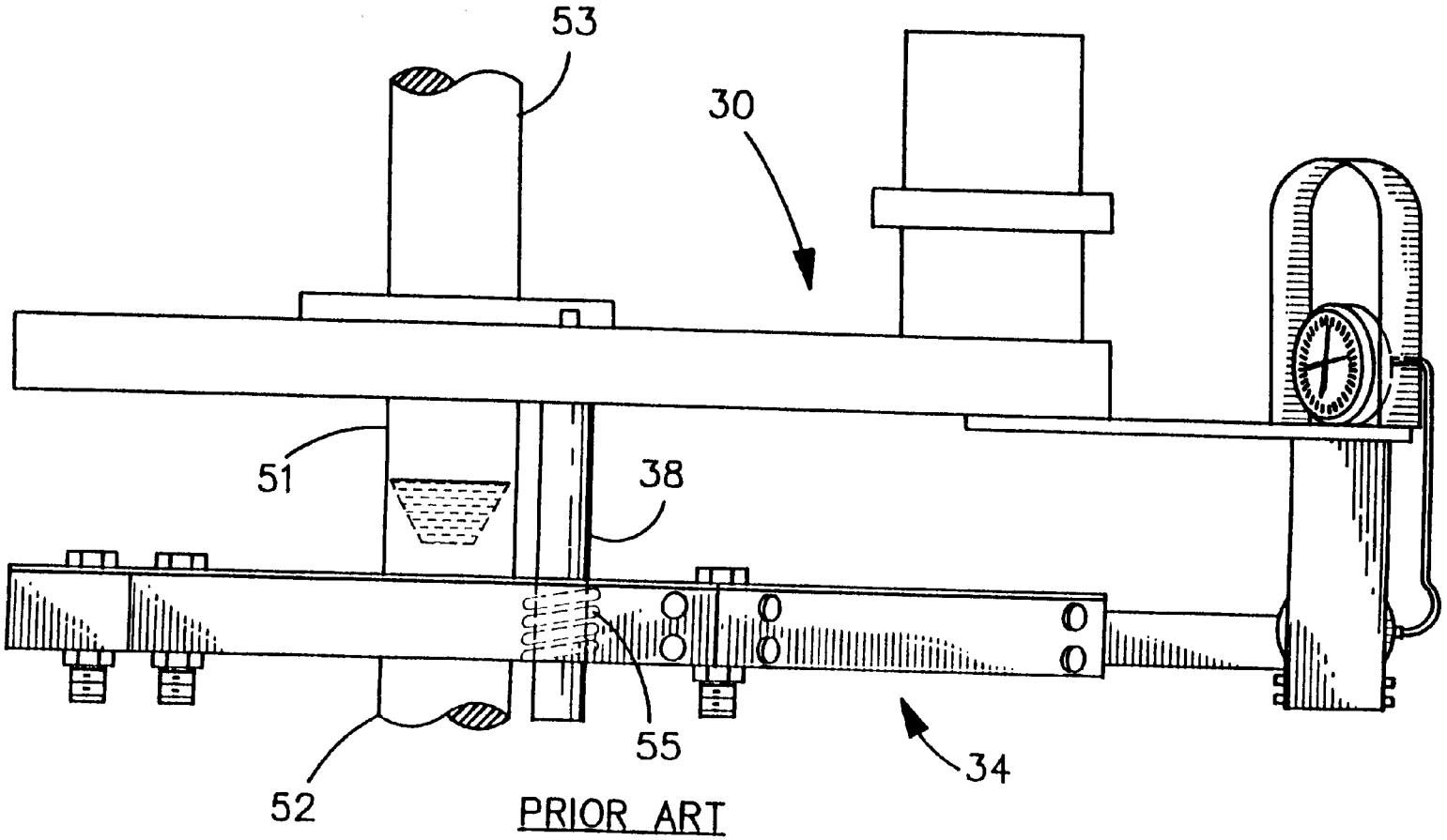
PRIOR ART FIGURE 5
FIG. 5 is a side view illustrating the typical combined use of power tongs and back-up power tongs.

The manner in which jaw members 40 are used in power tongs 30 and back-up tongs 34, as well as the main components of a typical prior art power tongs 30 and back-up tongs 34, are seen in FIGS. 3 and 4, respectively. FIG. 3 illustrates power tongs 30 which are intended to grasp a tubular 60 in jaw members 40 and rotate the jaw members 40 and tubular 60 by way of a ring gear 50. The back-up tongs 34 seen in FIG. 4 illustrate how back-up tongs are not designed to rotate the tubular 60, but rather to simply securely grasp the tubular 60 and hold it against rotation. FIG. 5 depicts how power tongs 30 are used in combination with back-up tongs 34 in order to make up or break apart a tubular joint 51. The frames of power tongs 30 and back-up tongs 34 are joined and maintained in alignment by guide legs 38. Typically the guide legs 38 are coupled with some type of resilient means, such as a heavy tension spring 55, which allows some relative movement between back-up tongs 34 and power tongs 30. However, because of the substantial weight of the back-up tongs 34, these springs must have considerable rigidity and only large forces will induce relative movement between power tongs 30 and back-up tongs 34.

In operation as shown in FIG. 5, the combination of tongs 30 and 34 will be positioned on the tubular string such that the joint 51 connecting the tubulars is between back-up tongs 34 and power tongs 30. In this manner, back-up tongs 34 may hold the lower tubular 52 immobile while power tongs 30 apply torque to the upper tubular 53 in order to make up or break apart the joint 51. It will be understood that as the joint is being made up, the distance between the tubulars decreases as the threaded portions of joint 51 come together. This causes an upward vertical force on the jaw members 40 in back-up tongs 34 and a downward vertical force on the jaw members 40 in power tongs 30. Conversely, when joint 51 is being broken apart, tubulars 53 and 52 move apart causing a downward force on the jaw members 40 of back-up tongs 34 and an upward force on the jaw members 40 of power tongs 30. Additionally, other circumstances may impart vertical forces to the power tongs 30 and back-up tongs 34. For example, the drill string may inadvertently be slightly raised or lowered while the tongs are gripping a tubular. Because the dies 41 have gripping surfaces 64 formed from teeth 65 with peaks 66, gripping surface 64 will be capable of preventing vertical slipping between the tubular member and the jaw members 40.

However, these vertical forces on the jaw members 40 are often sufficient to over stress the retaining screw 43 securing die 41, causing retaining screw 43 to fail and die 41 to be lifted from jaw member 40. While the spring devices 55 on guide legs 38 will allow some displacement between the tongs, these spring devices are typically so rigid that retaining screw 43 will fail prior to the spring devices being displace any appreciable distance.

Figure 6:
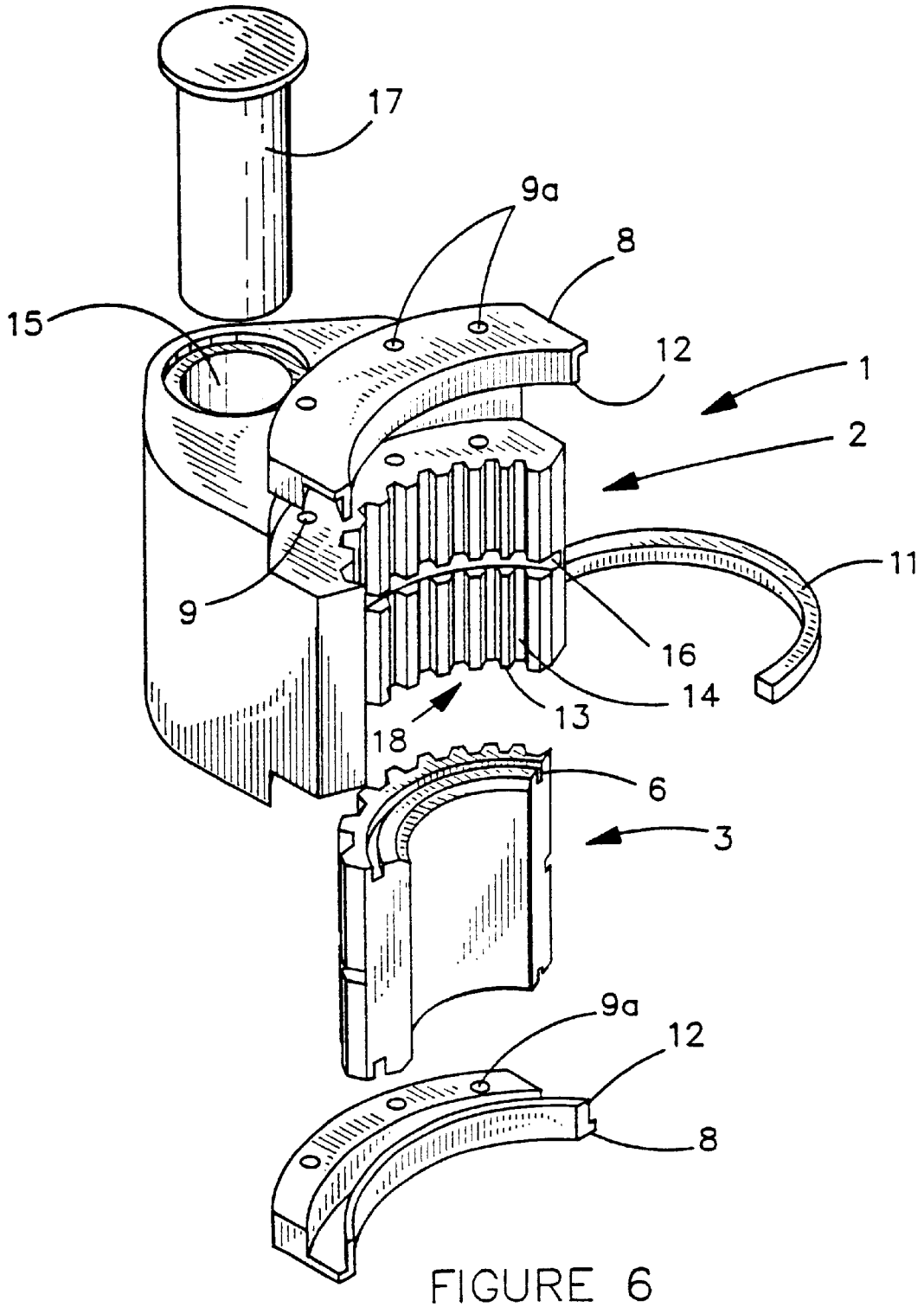
FIG. 6 is an exploded view of the jaw assembly of the present invention.
Figure 7:
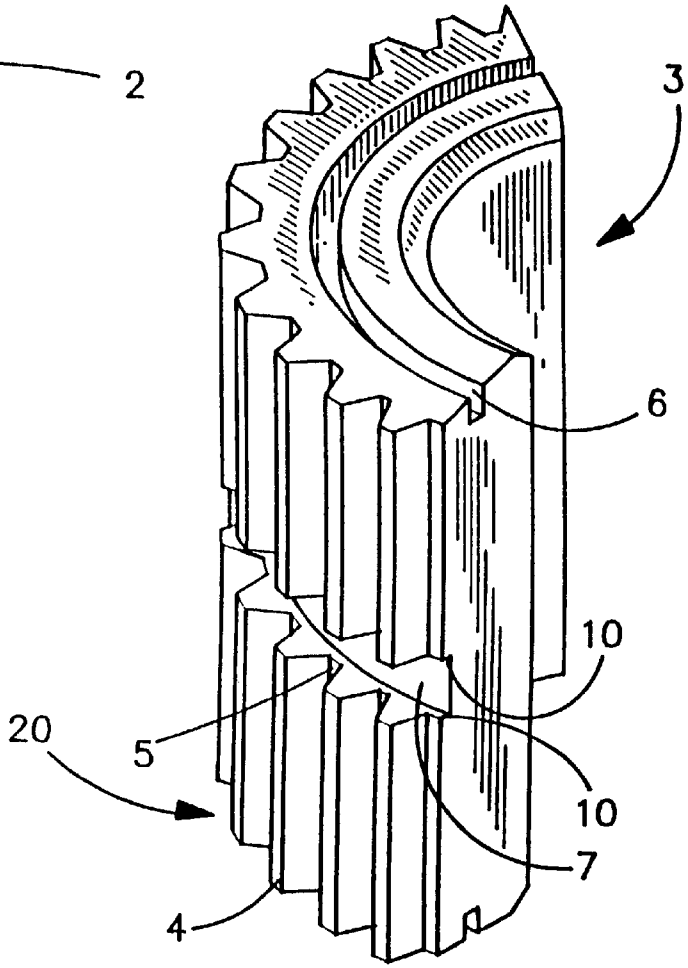
FIG. 7 is a rear perspective view of a die insert of the present invention.

To overcome these disadvantages in the art, FIG. 6 illustrates a novel jaw assembly which retains a die insert securely against far higher vertical loads than the prior art jaw assembly described above. Jaw assembly 1 will include jaw member 2 and removably insertable die 3. Jaw member 2 will have pinning aperture 15 through which pin 17 will be inserted to secure jaw assembly 1 in power tongs 30, back-up tongs 34 or other tools where jaw assemblies are employed. Jaw member 2 has a front surface 18 with splines 13 and grooves 14 formed thereon. As best seen in FIG. 7, rear surface 20 of die 3 also has splines 4 and grooves 5. When die 3 is inserted in jaw member 2, jaw member splines 13 and grooves 14 will mesh with die grooves 5 and splines 4 and will prevent lateral movement between jaw member 2 and die 3. Jaw assembly 1 further includes die retention clips 8 which have front edges 12 and retaining screw apertures 9*a*. It will be understood that when die 3 is inserted into jaw member 2, front edges 12 of retention clips 8 will engage die retaining channels 6 of die 3. When screws are threaded through apertures 9*a* in to apertures 9 in jaw member 2, die 3 will be held against forward and vertical movement within jaw member 2. It should be noted that there will be some variation in size and shape of the jaw assemblies 1 depending the size of pipe they are designed to grip and the type of tool in which they are to be used. Not all jaw assemblies 1 will require retention clips 8 if the size and amount of curvature in a particular jaw assembly is sufficient to prevent die 3 from moving forward out of jaw member 2. However, the embodiments of jaw assembly 1 illustrated herein all require retention clips 8.

Still viewing FIG. 6, it can be seen that jaw member 2 has a keyway 16 formed laterally across front surface 18. As best seen if FIG. 7, die 3 has a corresponding keyway 7 formed across its back surface 20. When die 3 is inserted into jaw member 2, keyways 16 and 7 will be aligned such that key 11 (FIG. 6) may be inserted in keyways 16 and 7. Key 11 may be formed of steel or any other material flexible enough to be inserted into the key yet hard enough to not seriously deform under the vertical forces encountered. By employing this key and keyway configuration, any vertical force tending to lift die 3 out of jaw member 2 will be resisted by the entire length of key 11 as opposed to merely the retaining screws found in the prior art. This key and keyway configuration allows die 3 to resist many times more vertical force than the prior art retaining screws were able to withstand. While key 11 in FIG. 6 is shown as a length of material having a square cross-section, any cross-sectional shape of key that will securely engage keyways 16 and 7 may be utilized. Furthermore, keyway 16 need not span the entire distance across the front surface 18 of jaw member 2, but could span less than the entire distance as long as a suitable provision is made for pulling key 11 out of the keyway rather than driving key 11 out the side opposite insertion as envisioned in the embodiment of FIG. 6.

Figure 8:
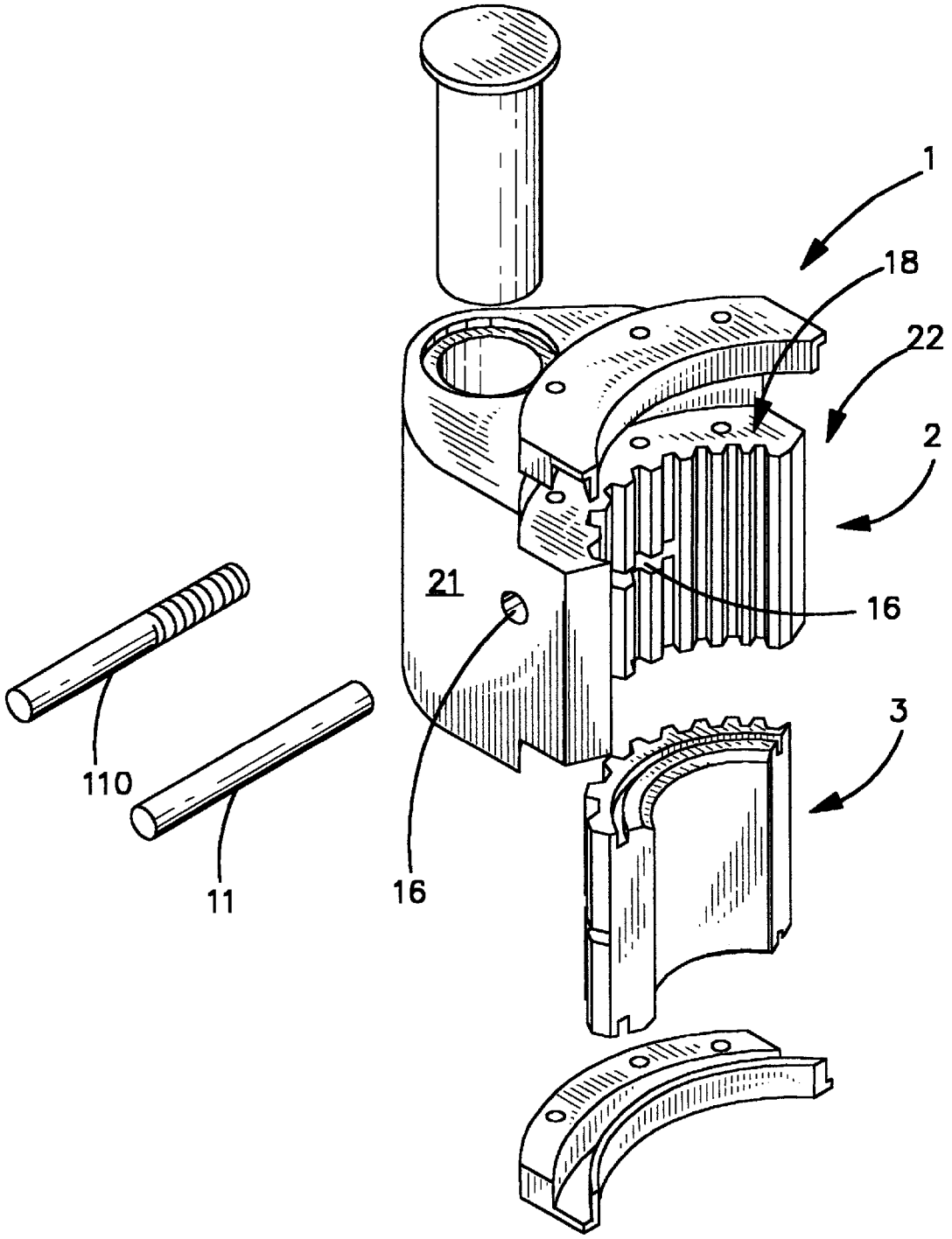
FIG. 8 is an exploded view of an alternate jaw assembly of the present invention.

An alternate embodiment of the present invention is shown in FIG. 8. Here jaw member 2 has a keyway 16 beginning in a first side 21 of jaw member 2 and extending through jaw member 2 to a second side 22 (hidden from view in FIG. 8). As suggested by the straight key 11, keyway 16 does not follow the concave shape of front surface 18, but rather travels on a straight line through jaw member 2. As seen in FIG. 8, this results in keyway 16 intersecting front surface 18 only along that portion of front surface 18 with the deepest concave curvature. While this embodiment illustrates a friction pin type key 11, it will be understood that a threaded key 110 as shown in FIG. 8 could also be employed if keyway 16 was threaded. Still other types of keys 11 could be used in place of friction pin key 11 or threaded key 110.

Figure 9:
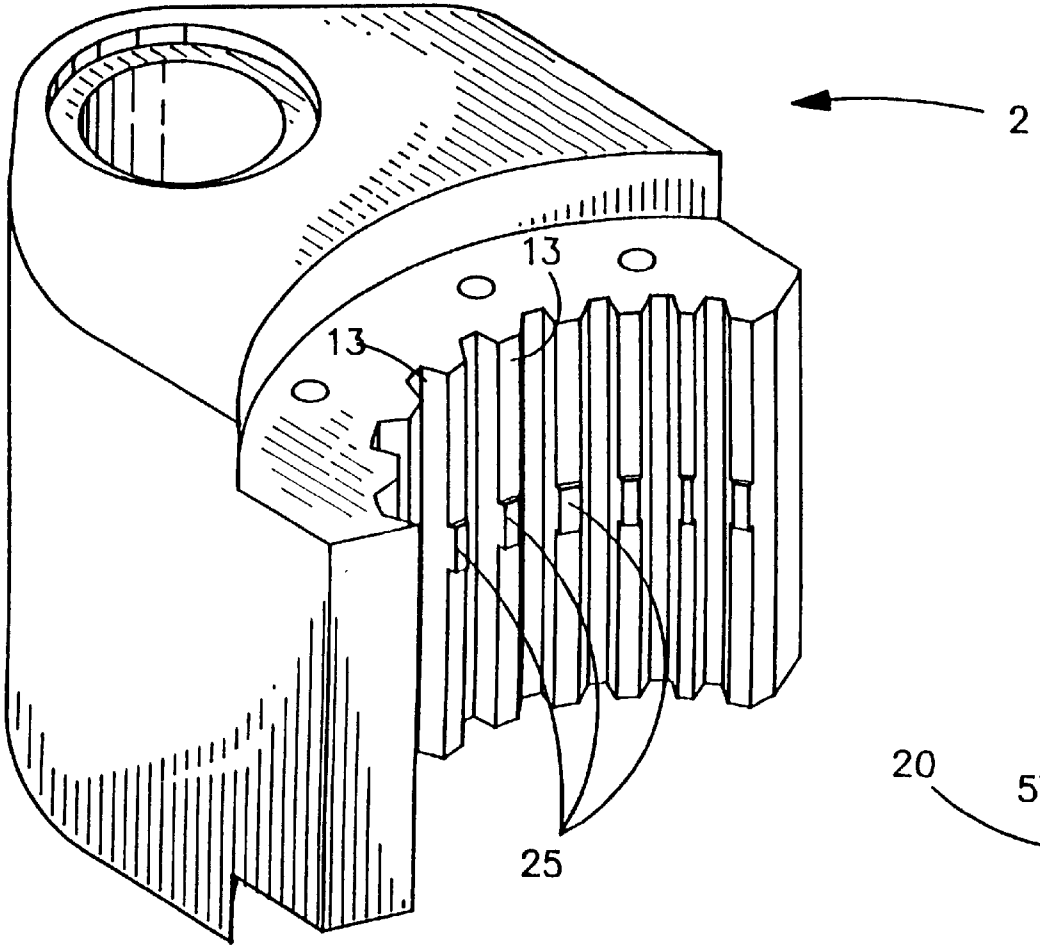
FIG. 9 is a perspective view of a jaw member which comprises a third embodiment of the present invention.

A third embodiment of the present invention is seen in FIG. 9 and illustrates an alternative method of forming a key 11. In this embodiment, jaw member splines 13 have discrete key extensions 25 formed approximate to the midpoint of each spline 13. Of course, less than all splines 13 could be provided with extensions 25. Nor do the extensions need to be at the midpoint of the spline as long as the corresponding keyway 7 on die 3 is positioned at the same level as key extensions 25. As best seen in FIG. 7, keyway 7 may be formed by cutting not just the splines 4 extending from rear surface 20, but also cutting a short distance into rear surface 20 itself. This produces upper and lower keyway shoulders 10 between which key extensions 25 become engaged. To install this embodiment of die 3 in jaw member 2, the retention clips 8 are removed and die 3 is placed against jaw member 2 such that key extensions 25 rest between keyway shoulders 10. Retention clips 8 are then attached to jaw member 2 securing die 3 in jaw member 2 and thereby securing key extensions 25 between keyway shoulders 10. It will be understood that a jaw member 2 having keyway extensions must be mated with dies 3 having keyway shoulders cut therein. Otherwise dies 3 will not fit closely enough against jaw members 2 in order that retention clips 8 may be properly attached between dies 3 and jaw members 2.

Finally, while many parts of the present invention have been described in terms of specific embodiments, it is anticipated that still further alterations and modifications thereof will no doubt become apparent to those skilled in the art. For example, while not shown in the drawings, the term jaw member is intended to include slips, elevators or other holding devices used in the oil and gas industry for suspending and lifting tubular members. Conventional slips or elevators could be adapted to the present invention by being manufactured with a removable die as the gripping surface. The slip or elevator body would be formed with a concave surface having splines and grooves similar to the jaw member 2 seen in FIG. 9. Dies 3 could then be removably inserted in the elevator or slip and later replaced when the die gripping surface became excessively worn. This example is just one possible modification of the present invention and it is intended that the following claims be interpreted as covering all such alterations and modifications as fall within the true spirit and scope of the invention.

I claim:

1. A jaw assembly for gripping tubular members, comprising:

a. a jaw member, attachable to a gripping mechanism, said jaw member having:

i. a concave surface provided with a plurality of parallel splines radially spaced over said concave surface, forming parallel grooves between said splines, each said spline extending outward substantially perpendicular from said concave surface; and ii. a jaw keyway formed on said concave surface and intersecting said splines;

b. a die member removably insertable within said jaw member, said die member having:

i. a convex surface provided with a plurality of parallel splines radially spaced over said convex surface, forming parallel grooves between said splines, said splines on said die member being positioned to engage said parallel grooves on said jaw member;

ii. a gripping surface formed on a side opposite said convex surface, said gripping surface including a plurality of raised teeth, said teeth having peaks and forming intersecting depressions between said peaks; and c. a key sized to engage said jaw keyway when said die member is inserted within said jaw member.

2. A jaw assembly according to claim 1, wherein said key is formed on said concave surface of said jaw member.

3. A jaw assembly according to claim 1, wherein said convex surface of said die member includes a die keyway formed thereon and said key is sized to engage an aperture defined by said jaw keyway and said die keyway when said die member is inserted within said jaw member.

4. A system for making up or breaking apart a threaded joint on a tubular member comprising:

a. a power tong gripping a first section of said tubular member on one side of said threaded joint;

b. a back-up power tong gripping a second section of said tubular member on an opposite side of said threaded joint in order to hold said second section against rotation;

c. one of said power tong or back-up power tong have a jaw assembly, said jaw assembly including:

i. a jaw member, attachable to a gripping mechanism, said jaw member having: a concave surface provided with a plurality of parallel splines radially spaced over said concave surface, forming parallel grooves between said splines, each said spline extending outward substantially perpendicular from said concave surface; and a jaw keyway formed on said concave surface and intersecting said splines;

ii. a die member removably insertable within said jaw member, said die member having:

a convex surface provided with a plurality of parallel splines radially spaced over said convex surface, forming parallel grooves between said splines, said splines on said die member being positioned to engage said parallel grooves on said jaw member;

a gripping surface formed on a side opposite said convex surface, said gripping surface including a plurality of raised teeth, said teeth having peaks and forming intersecting depressions between said peaks; and iii. a key sized to engage said jaw keyway when said die member is inserted within said jaw member.

* * * * *